US005960593A

United States Patent [19]

Murphy

[11] Patent Number: 5,960,593

[45] Date of Patent: Oct. 5, 1999

[54] COLLAPSIBLE BUILDING

[75] Inventor: Patrick Murphy, Dalkey, Ireland

[73] Assignee: Pat's Tent Limited, Dublin, Ireland

[21] Appl. No.: 08/841,330

[22] Filed: Apr. 30, 1997

Related U.S. Application Data

[63] Continuation of application No. 08/586,711, filed as application No. PCT/IE94/00041, Jul. 28, 1994, abandoned.

[30] Foreign Application Priority Data

Jul. 28, 1993 [IE] Ireland ..... S930569

[51] Int. Cl.[6] ..... E04B 1/343

[52] U.S. Cl. ..... 52/79.5; 52/143; 52/643

[58] Field of Search ..... 52/64, 66, 68, 52/69, 71, 79.5, 143, 643

[56] References Cited

U.S. PATENT DOCUMENTS

| | | | |
|---|---|---|---|
| 2,603,171 | 7/1952 | Smith | 52/643 X |
| 2,765,499 | 10/1956 | Couse | 52/66 |
| 2,920,920 | 1/1960 | Couse et al. | 52/68 X |
| 3,714,746 | 2/1973 | Barlow | 52/66 X |
| 4,603,518 | 8/1986 | Fennes | 52/66 |
| 4,660,332 | 4/1987 | Colvin, Jr. | 52/71 X |
| 4,829,726 | 5/1989 | de Potter d'Indoye | 52/66 |
| 4,912,891 | 4/1990 | Bertrand | 52/71 X |
| 4,958,874 | 9/1990 | Hegedus | 52/66 X |
| 5,218,794 | 6/1993 | Ehrlich | 52/64 |
| 5,283,993 | 2/1994 | Sprung, Sr. | 52/64 |
| 5,461,832 | 10/1995 | Smith | 52/69 |

FOREIGN PATENT DOCUMENTS

| | | | |
|---|---|---|---|
| 0 329 261 | 8/1989 | European Pat. Off. . | |
| 4-140342 | 5/1992 | Japan | 52/641 |
| 6560 | 2/1912 | United Kingdom . | |
| 523333 | 7/1940 | United Kingdom . | |
| 708528 | 5/1954 | United Kingdom . | |
| 2085941 | 5/1982 | United Kingdom . | |
| 2145379 | 3/1986 | United Kingdom . | |
| WO86/05829 | 10/1986 | WIPO . | |

*Primary Examiner*—Michael Safavi

*Attorney, Agent, or Firm*—Jacobson, Price, Holman & Stern, PLLC

[57] ABSTRACT

A collapsible building including a semi-trailer chassis. At each side of the chassis a pair of sidewalls are foldable between a collapsed position on the chassis for transport and an outwardly extended in-use position. Ground-engaging support legs are provided at an outer end of each sidewall. In the extended in-use position, a collapsible floor extends between each pair of sidewalls, the floor having a number of hinged panels which collapse onto the chassis sliding along the sidewalls. A folding roof is formed by a number of rafters movable from a nested position on the chassis to extend out along a top of the sidewalls, slidably engaging the sidewalls. An end wall extends between free ends of the sidewalls.

15 Claims, 14 Drawing Sheets

COLLAPSIBLE BUILDING

This application is a continuation of U.S. application Ser. No. 08/586,711 filed Apr. 4, 1996, now abandoned, which is a 371 filing of PCT/IE94/00041 filed Jul. 28, 1994.

The invention relates to a transportable and collapsible temporary building.

Marquees and the like are commonly used at sports functions, for example, to provide a temporary restaurant or bar facility. Putting up the marquee on site is a relatively labour intensive and time consuming job.

Examples of some collapsible buildings mounted on a transport chassis are described in Patent Specification Nos. GB 2145379, GB 708528 and GB 523333. However, these are relatively small structures of constructions which are unsuitable for a large temporary folding building which the present invention is primarily concerned with. Large folding structures involve the movement of relatively large and heavy structural elements during folding and unfolding. By virtue of their size and weight, these large structural elements can be damaged by their own weight, or by wind forces in exposed sites when being folded or unfolded. There is also a risk of injury to personnel carrying out the folding operation.

The present invention is directed towards providing an improved temporary building which overcomes these problems.

According to the invention there is provided a transportable and collapsible temporary building, comprising a wheeled chassis, at least two building sidewalls mounted on the chassis for movement between a collapsed stored position on the chassis and an outwardly extended in-use position, one or more ground engaging supports engagable between each sidewall and the ground to support each sidewall in the extended position, a collapsible roof extendable between the sidewalls and a collapsible floor extendable between the sidewalls. Advantageously, all the principal components of the building are attached to the body and therefore there is no danger of any major structural elements being omitted or delayed during transport, all the major structural elements being kept together. The sidewalls, roof and floor can be readily easily and quickly folded outwardly from the body to form the building and similarly easily collapsed on the body after use.

In one embodiment of the invention, the floor is engagable with the sidewalls for movement of the floor on the sidewalls between a collapsed stored position on the chassis through an intermediate partially extended position supported between the sidewalls and a fully extended position supported between the sidewalls. Thus advantageously, the floor is adequately supported at all times, this being particularly important in view of the size and weight of the floor assembly.

In a preferred embodiment, the sidewalls and floor are interengagable to retain the sidewalls in a floor supporting position. Thus advantageously, the floor is prevented from slipping off the sidewalls.

In another embodiment the floor comprises a number of foldable panels interconnected by hinge joints with rollers being provided adjacent outer ends of some of the hinge joints slidably engaging complementary tracks on the sidewalls. Conveniently, the floor can be folded concertina fashion for opening out or collapsing the floor on the sidewalls. Typically, rollers are provided at every second hinge joint.

Preferably, bias means is provided to urge the panels towards a folded position. This feature advantageously assists in folding the floor from a fully open position by counteracting the weight of the panels.

Conveniently, the bias means comprises a number of springs mounted between adjacent floor panels, the springs being extendable from a neutral position when the panels are in a folded position to an expanded tensioned position when the panels are in an open floor-forming position.

In a further embodiment, ram means is provided at one or more hinge joints connected between adjacent panels, the ram means being operable to initiate folding of the panels from the open floor-forming position.

Ideally, drive means is provided for movement of the floor between a collapsed stored position and an extended position. Preferably, the drive means is a rack mounted along each sidewall with associated pinions mounted on a drive shaft on the floor, the drive shaft connected to a drive motor for rotation of the pinions.

In a preferred embodiment, the floor and sidewalls are interengagable by means of pairs of spaced-apart rollers mounted at each side of the floor and engagable with each side of the rack which passes between the rollers.

In another embodiment, the roof is movable between a nested folded position on the body between the sidewalls through a raised folded position on the body adjacent an upper end of each sidewall and a raised extended position between the sidewalls. Thus, the roof can advantageously be retained on the chassis when folded in a neat and compact position. Preferably, the roof is supported on a carriage which is vertically movable on the body for raising and lowering the folded roof on the body.

In a particularly preferred embodiment, the roof is formed by a number of rafters having rollers at each end engagable with complementary tracks at a top of each sidewall and roof cladding for mounting between the rafters in the extended position. Conveniently, the roof cladding is attached to the rafters.

Preferably, the roof cladding is of flexible material. Ideally, the roof cladding comprises flexible sheets of material mounted between adjacent rafters. In a particularly preferred embodiment, a double-skinned roof is provided having outer roof sheets between outer ends of the rafters and inner ceiling sheets mounted between inner ends of the rafters.

In another embodiment, each roof cladding sheet has a bead along each side edge of the sheet located in a complementary socket extending along a side edge of each rafter.

In a further embodiment, an end wall is mounted at a free end of the floor.

In one embodiment, the end wall is pivotally mounted on the floor for movement between a folded position against a floor panel and an upright in-use position extending between the sidewalls.

In another embodiment the end wall is supported vertically at a free end of the floor and is movable in an upright position with the floor along the sidewalls.

Preferably, the sidewalls are hingedly attached to the body. Ideally, the sidewalls are mounted on the body by slotted hinges to allow some movement of the sidewalls or chassis to allow for ground subsidence and setting up tolerance.

In a particularly preferred embodiment, two sets of sidewalls, floor and roof are provided mounted at opposite sides of the body extendable to form a temporary building which extends outwardly of each side of the body.

In another embodiment, the wheeled chassis is formed by portion of a lorry chassis. Alternatively, the wheeled chassis is formed by a semi-trailer chassis.

The invention will be more clearly understood by the following description of some embodiments thereof, given by way of example only, with reference to the accompanying drawings, in which.

Figure 1:
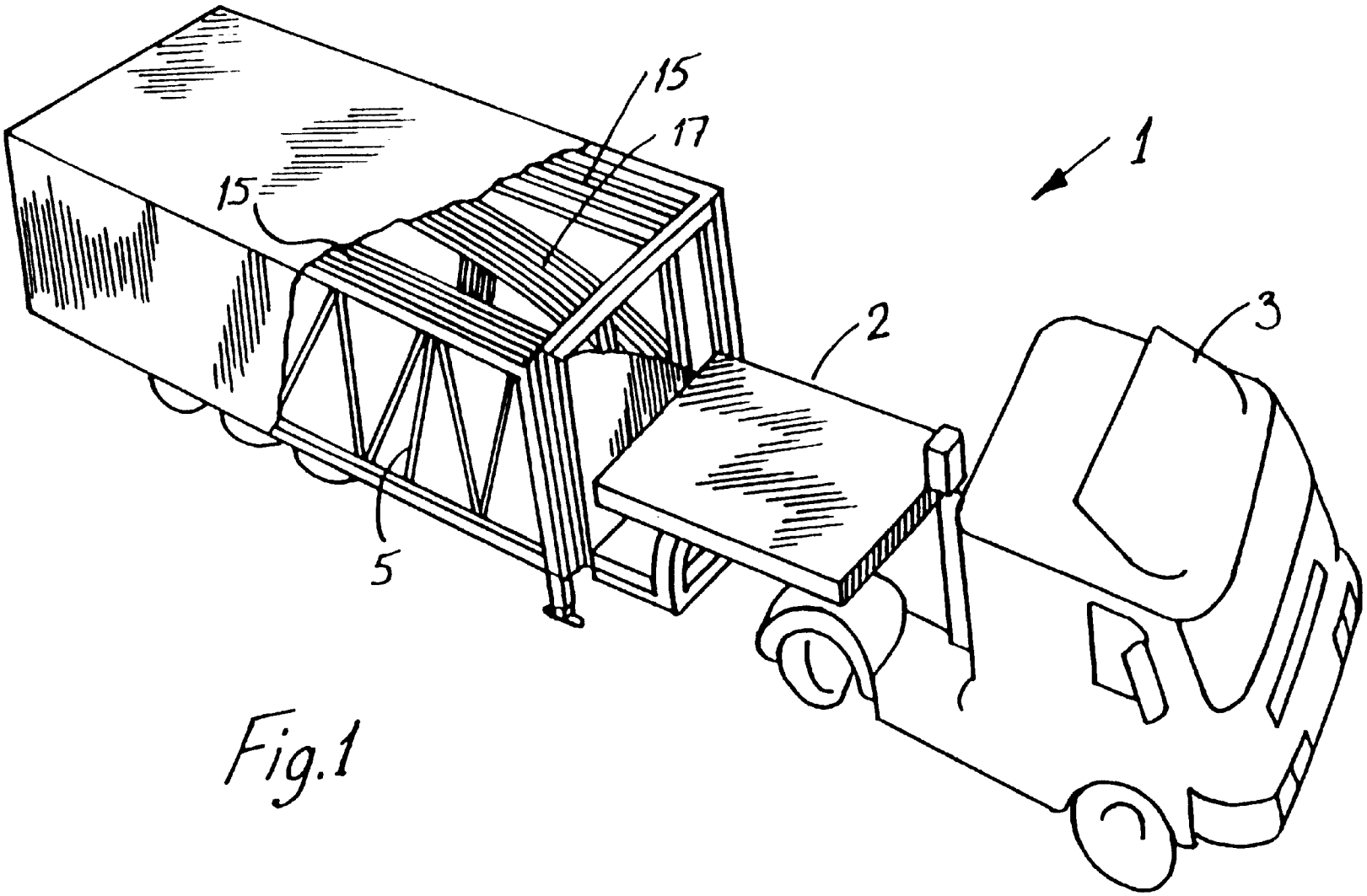
FIG. 1 is a perspective, partially cut-away view of a transportable and collapsible temporary building according to the invention.

Referring to the drawings, there is illustrated a transportable and collapsible temporary building according to the invention, indicated generally by the reference numeral 1. In a number of the drawings, cladding for sidewalls, floor and roof of the building 1 has been omitted for clarity.

The building 1 has a wheeled chassis 2 formed by a semi-trailer for towing behind a tractor vehicle 3. The chassis 2 has retractable ground supports (not shown) for levelling and supporting the chassis when the building is in use. A pair of building sidewalls 5 are hingedly mounted on each side of the chassis 2 for movement between a collapsed stored position on the chassis 2 as shown in FIG. 1 and an outwardly extended in-use position as shown in FIGS. 2 to 5. It will be noted that in the extended in-use position, the sidewalls 5 extend outwardly of the chassis 2 substantially parallel to each other and perpendicular to the chassis 2. Upright frames 6 at each end of the chassis 2 support the walls 5.

Height adjustable ground-engaging legs 8 are provided at a free outer end of each sidewall 5 for engagement between the sidewall 5 and the ground to support each sidewall 5 in the extended position. In some cases, a castor or wheel may be mounted at a lower end of each leg 8 to further facilitate folding of the walls 5. A pair of bracing bars 12 are provided for mounting between outer ends of each pair of sidewalls 5 in the extended position.

Figure 2:
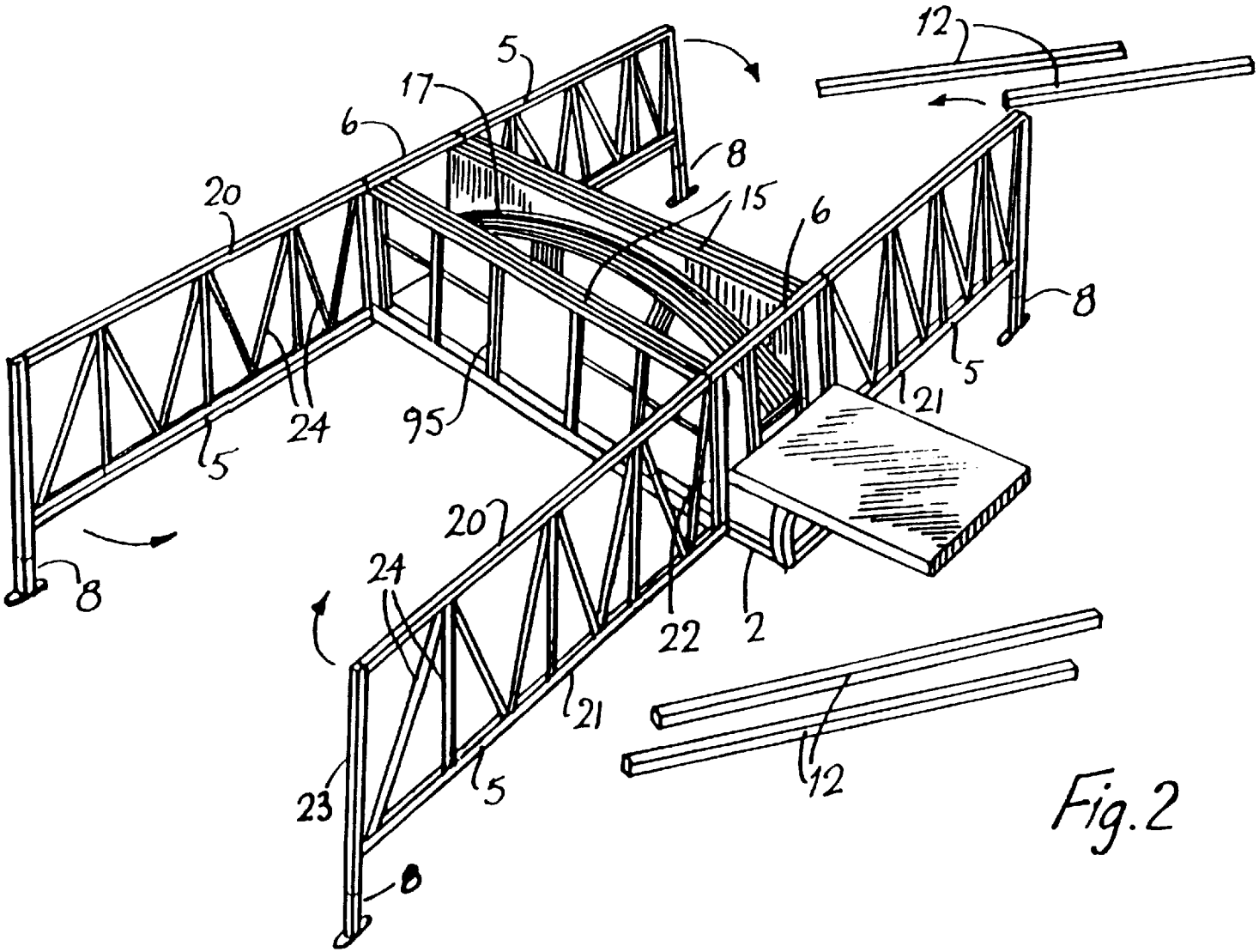
FIG. 2 to FIG. 5 are perspective views showing the building being erected in a number of steps.
Figure 3:
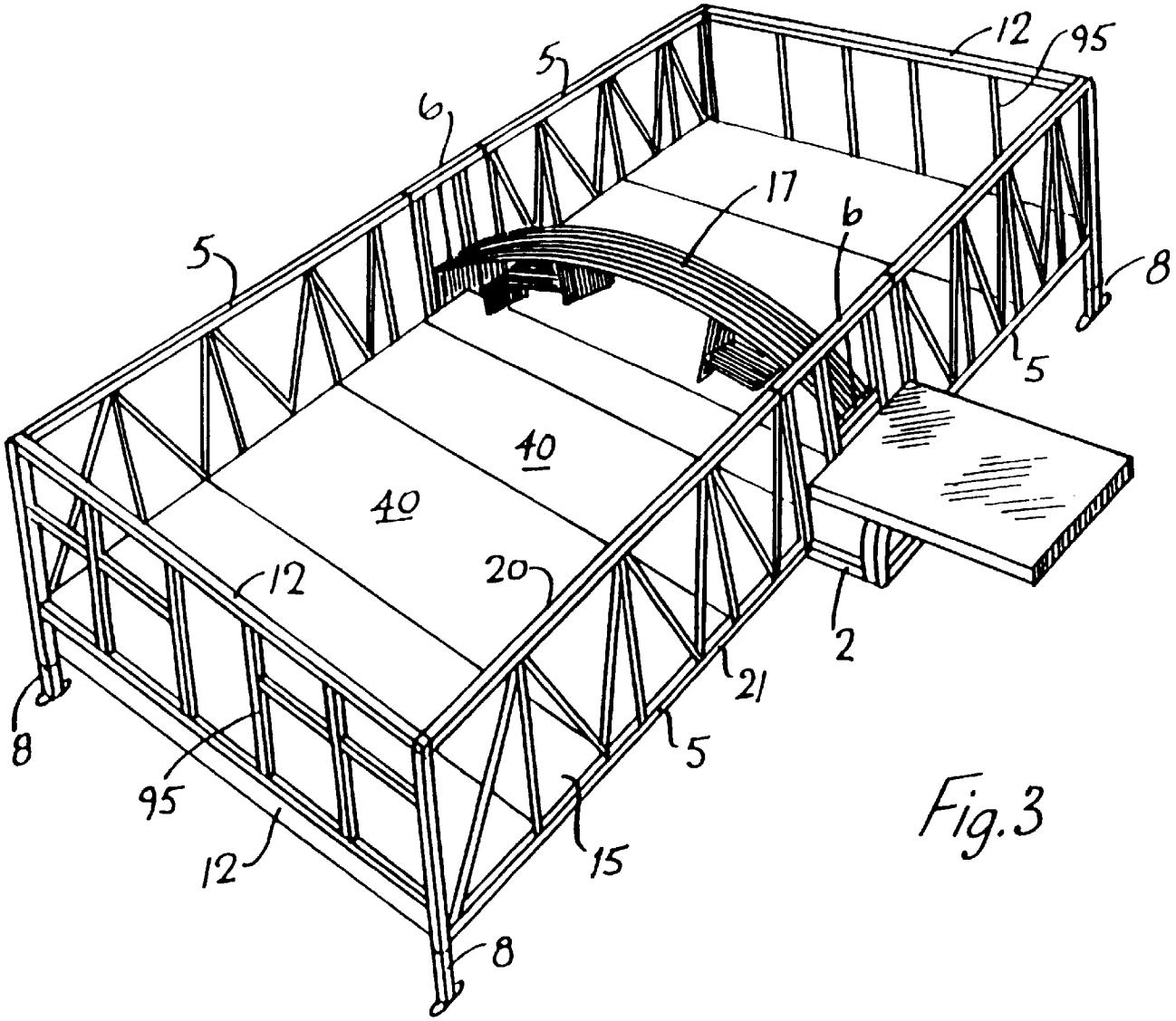
Figure 4:
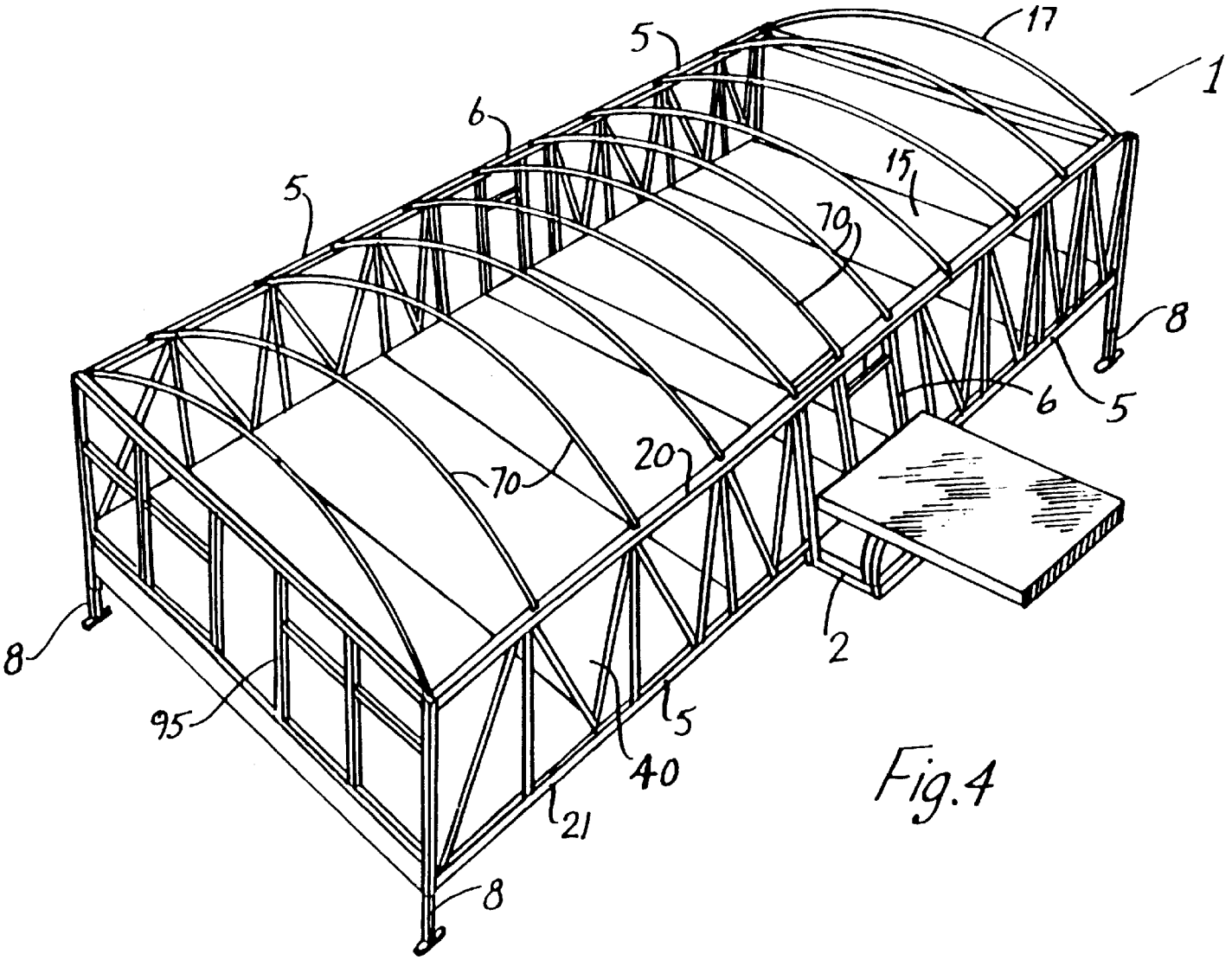

A floor assembly 15 is extendable between the sidewalls 5 between a collapsed stored position on the chassis 2 (as shown in FIG. 2) and an extended position as shown in FIG. 3. A roof assembly 17 can also be raised from a stored position (FIG. 2) on the chassis 2 and extended along a top of each sidewall 5 as shown in FIG. 4.

Each sidewall 5 is of similar construction comprising a rectangular metal frame having a top cross beam 20 and a bottom cross beam 21. An inner upright 22 and an outer upright 23 interconnect the ends of the beams 20, 21. Strengthening struts 24 are mounted between the beams 20, 21.

Figure 8:
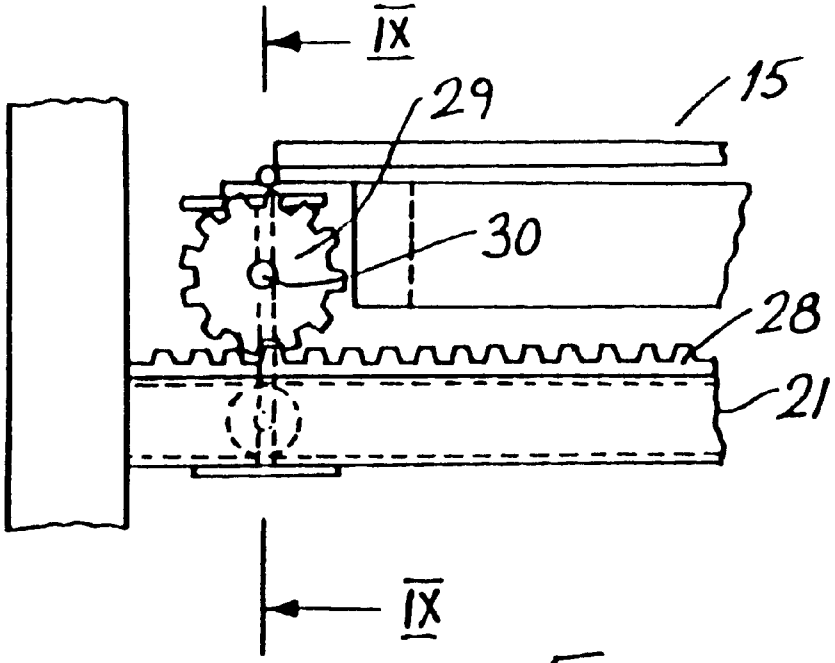
FIG. 8 is a detail side elevational view of a rack and pinion forming portion of the floor assembly.
Figure 12:
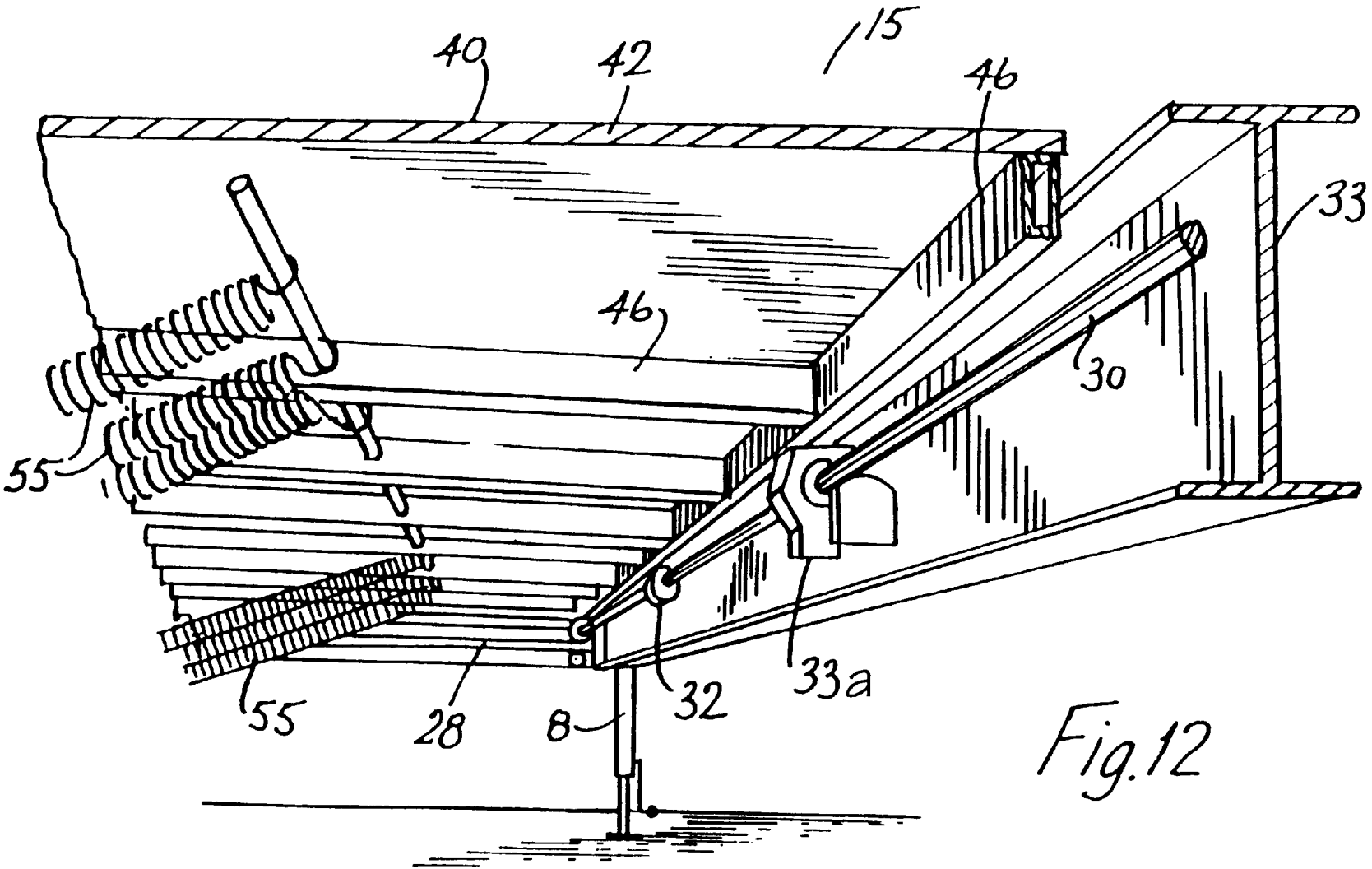
FIG. 12 is another detail underneath view of the floor assembly.

A gear rack 28 (FIGS. 8 to 10) is mounted on an upper surface of each bottom beam 21 and is engagable by a complementary pinion 29 mounted at an outer free end of the floor assembly 15. A pair of pinions 29 are provided mounted at either end of a drive shaft 30 supported in bearings 32 (FIG. 12) on a floor beam 33 at a free end of the floor assembly 15. An hydraulic motor 33*a* on the beam 33 drives the shaft 30 for rotation of the pinions 29 to move the floor assembly 15 along the sidewalls 5.

Figure 9:
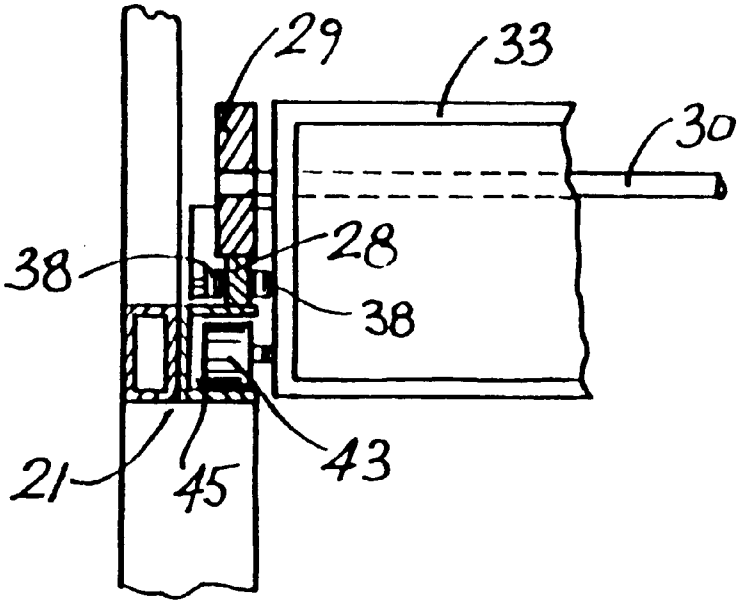
FIG. 9 is a detail sectional view along the line IX—IX of FIG. 8.
Figure 10:
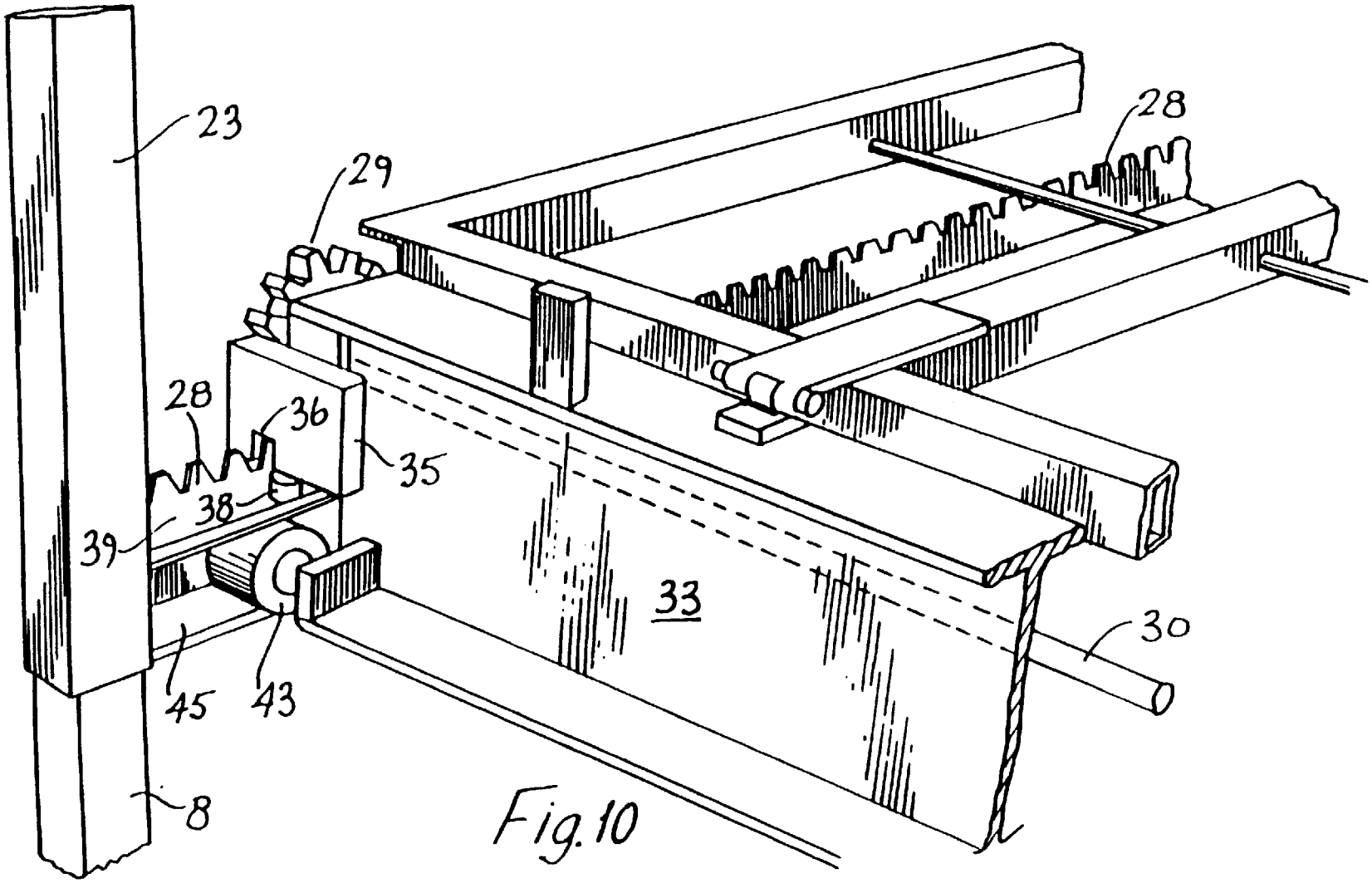
FIG. 10 is a detail perspective view showing portion of the floor assembly.

Referring in particular to FIGS. 9 and 10, it will be noted that a straddle block 35 is provided at each end of the beam 33. The straddle block 35 has a slot 36 for reception of the rack 28. Also, rollers 38 mounted on the straddle block 35 at each side of the slot 36 engage each side face 39 of the rack 28 to prevent lateral movement of the beam 33 on the bottom beams 21 of the sidewalls 5.

Figure 7:
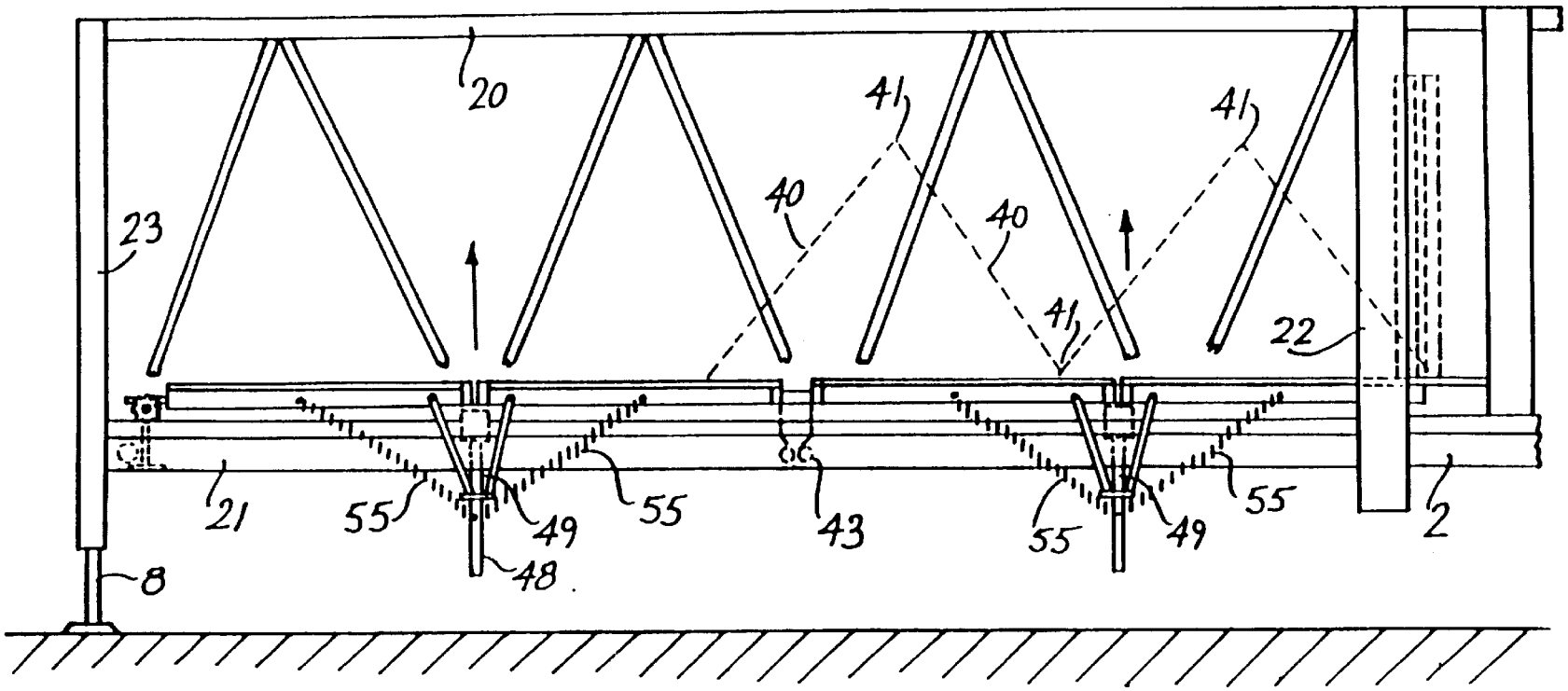
FIG. 7 is a detail side elevational view of the building partially constructed.

The floor assembly 15 is formed from a number of panels 40, formed by deck cladding 42 on a support frame 46, which fold together concertina-fashion by means of interconnecting hinge joints 41 (FIG. 7). At an outer end of each second hinge joint 41, a pair of rollers 43 are provided, one at each side of an upright web of an I-section support beam—similar to the beam 33—which is provided at said hinge joints 41. The double rollers improve stability. It will be noted that each bottom beam 21 of the sidewall 5 has an inwardly facing channel providing a track 45 along which the rollers 43 run.

Figure 6:
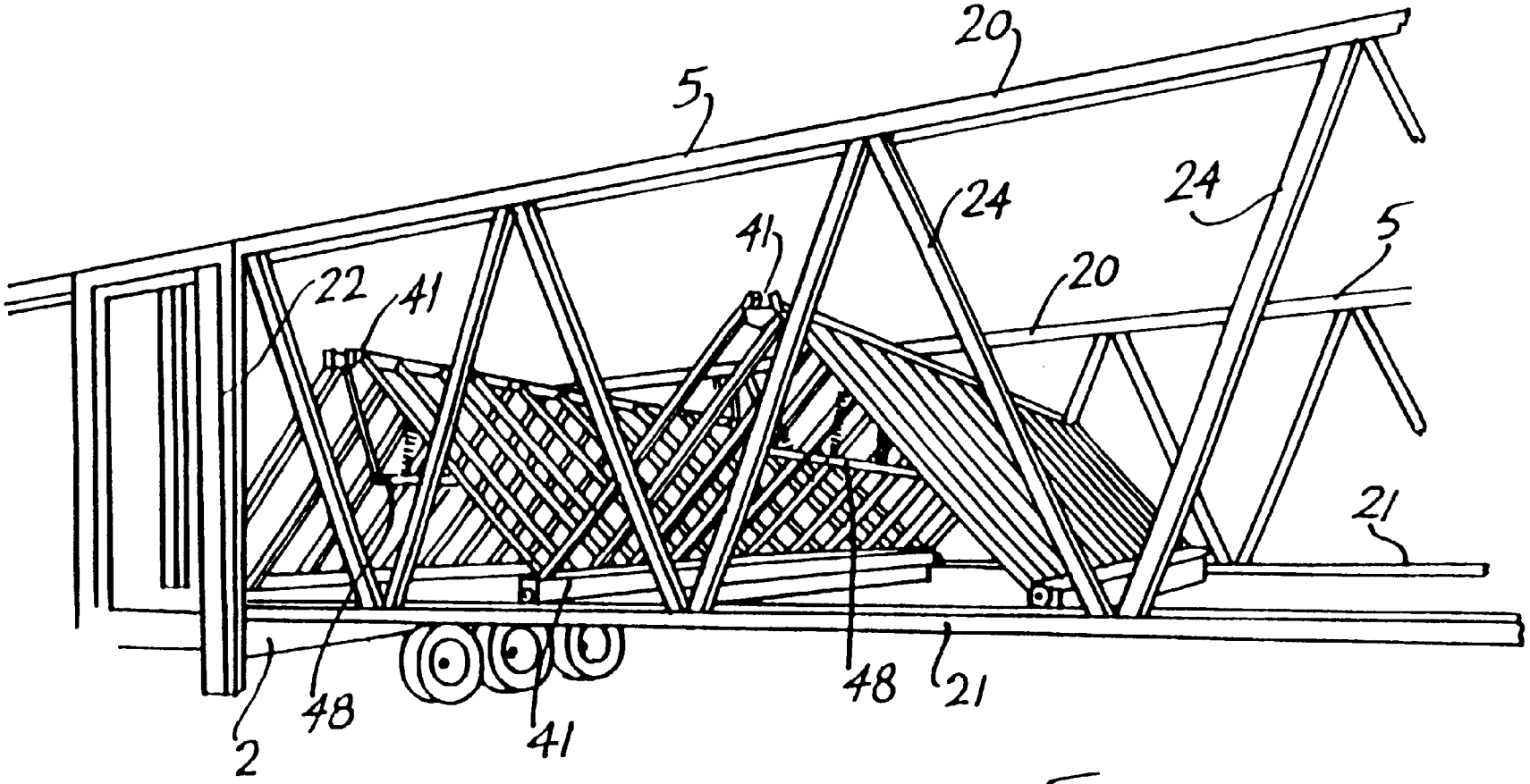
FIG. 6 is a detail perspective view showing extension and formation of a floor of the building.
Figure 11:
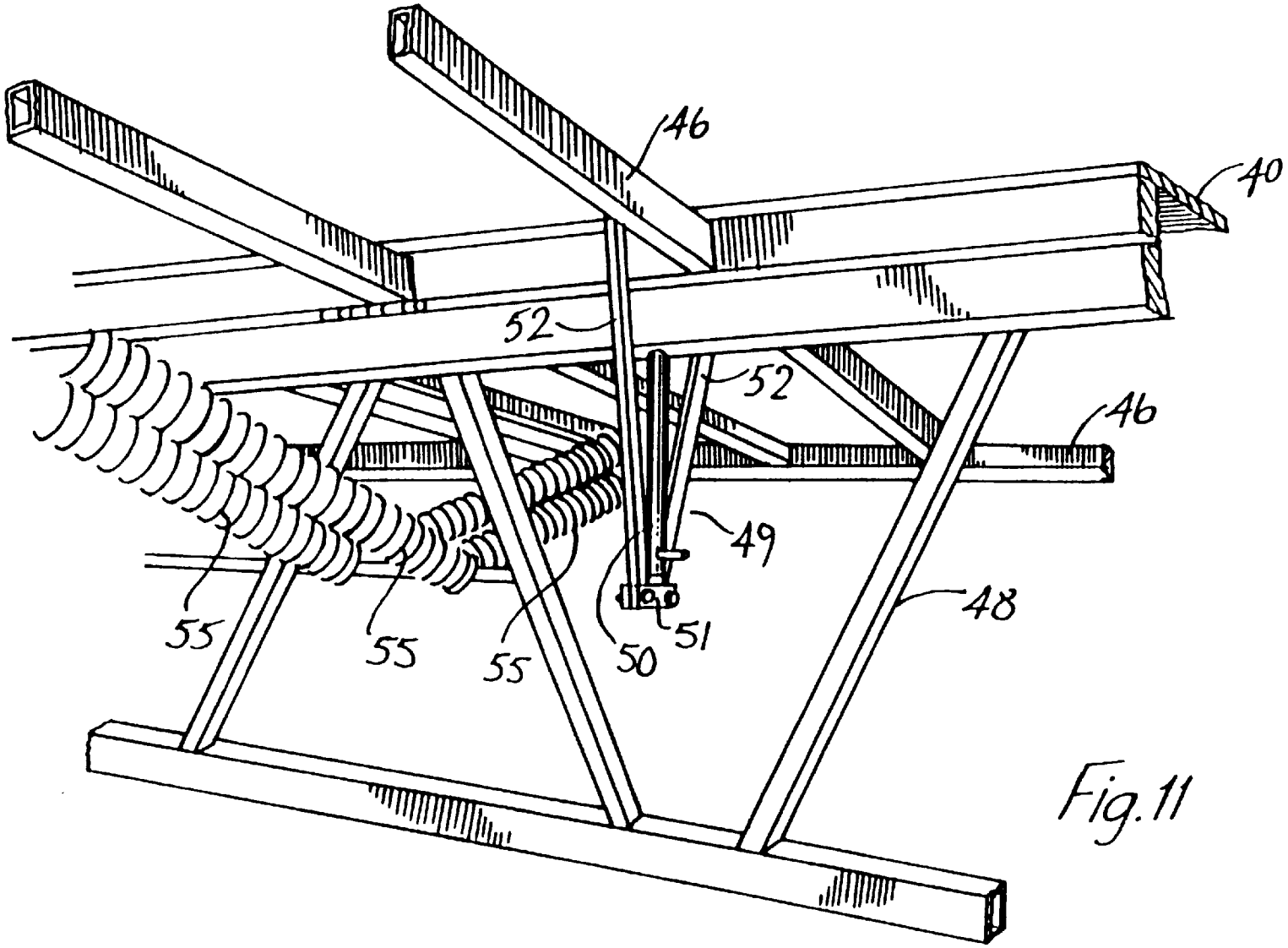
FIG. 11 is a detail underneath perspective view of portion of the floor assembly.

Referring in particular to FIGS. 6 and 11, it will be noted that a support frame 48 is provided at each of the free hinge joints 41. A ram 49 has a cylinder 50 mounted on the frame 48 and a piston 51 connected by struts 52 to each adjacent floor panel 40 such that by operation of the ram 49, the floor panels 40 are urged towards the collapsed position. Further, springs 55 mounted between the frame 48 and an underside of the adjacent floor panels 40 urge the floor panels 40 towards the collapsed position. However, the strength of the springs 55 is not sufficient in itself to raise the floor panels 40 from a flat in-use position as shown in FIG. 3, without the assistance of the ram 49.

Figures 13, 14:
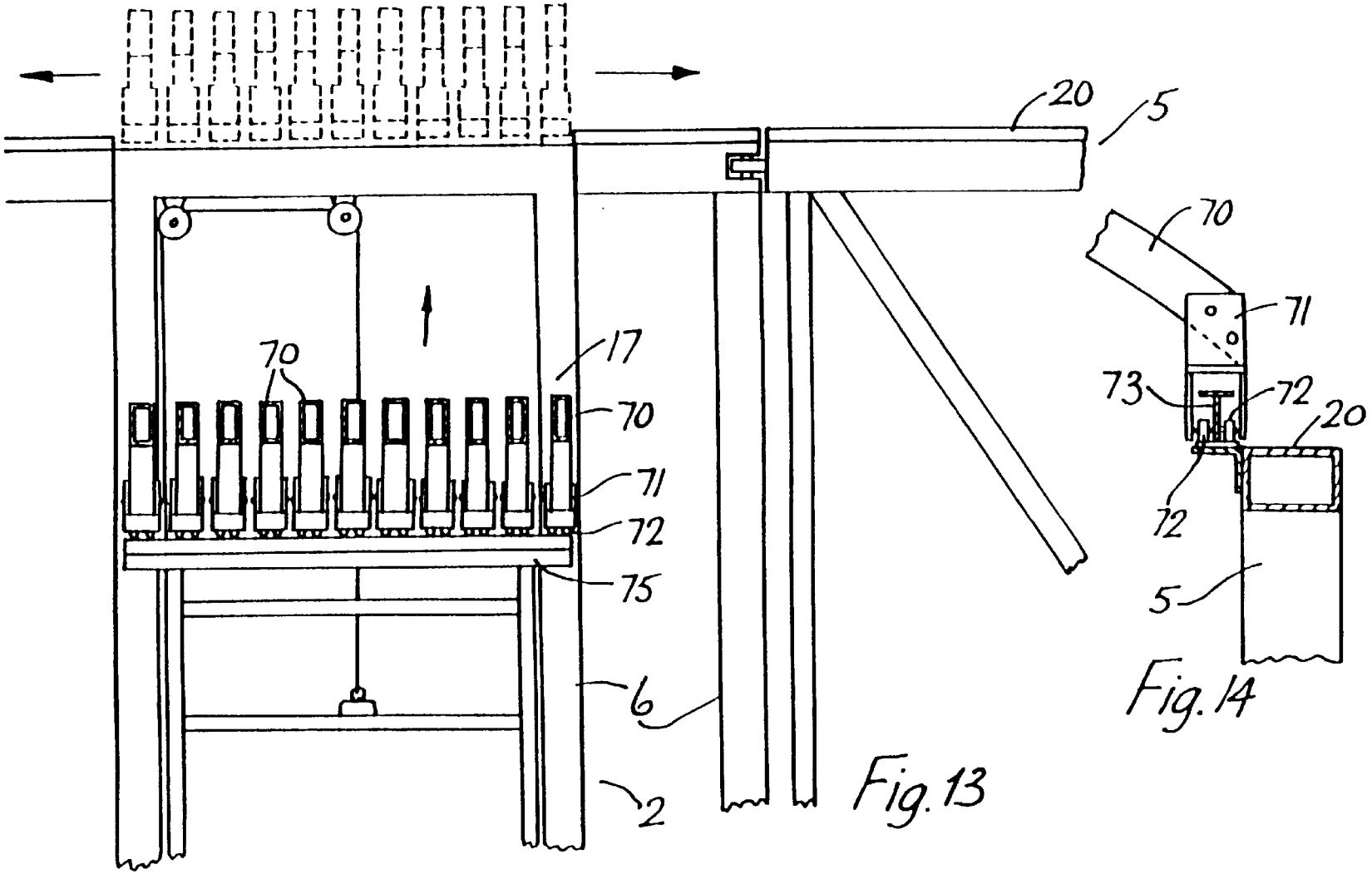
FIG. 13 is a detail, partially sectioned, end elevational view of a roof assembly of the building.
FIG. 14 is a detail sectional view showing portion of the roof assembly.
Figure 15:
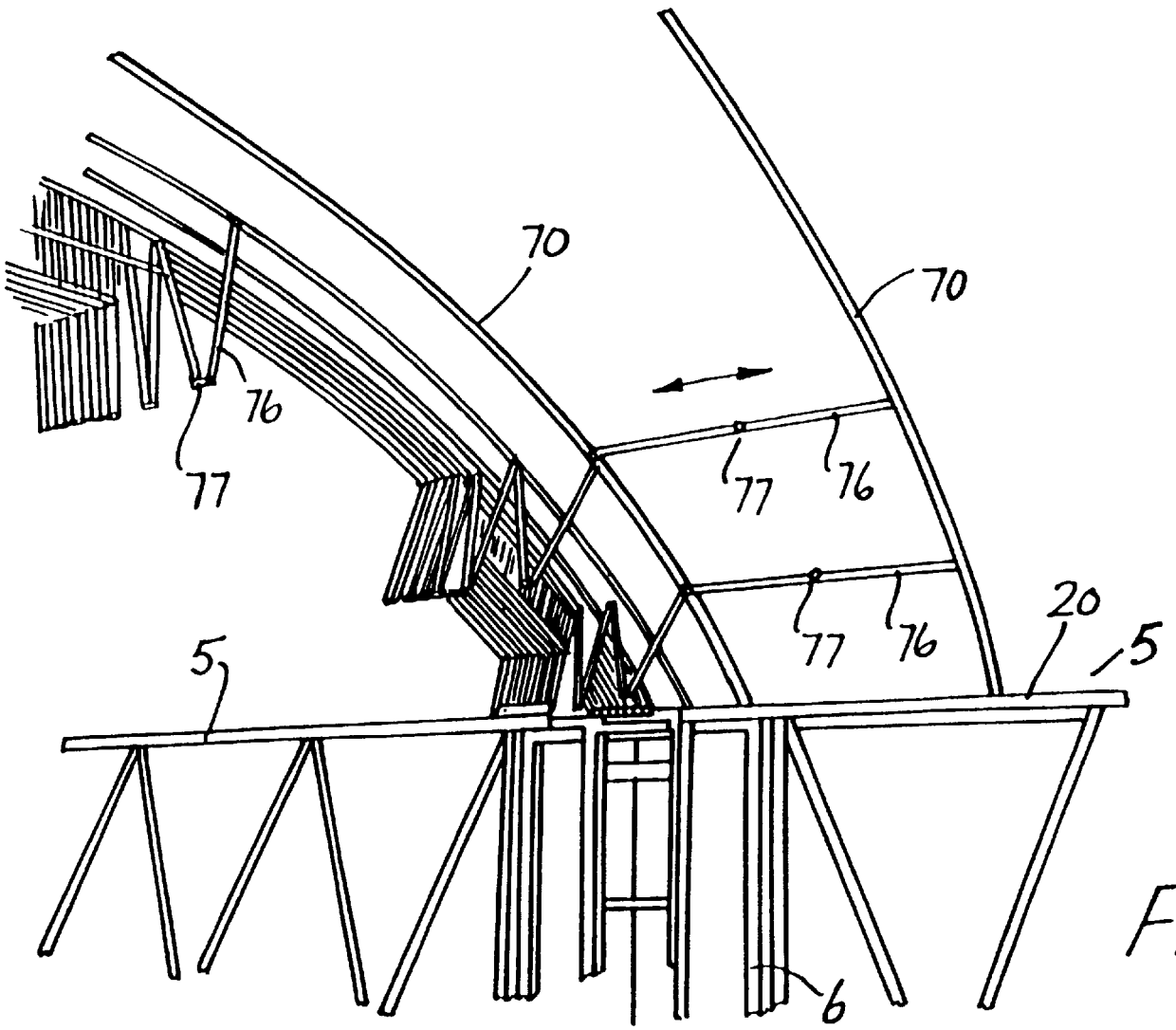
FIG. 15 is a detail perspective view showing the roof assembly in a partially extended position.
Figures 16, 17, 18:
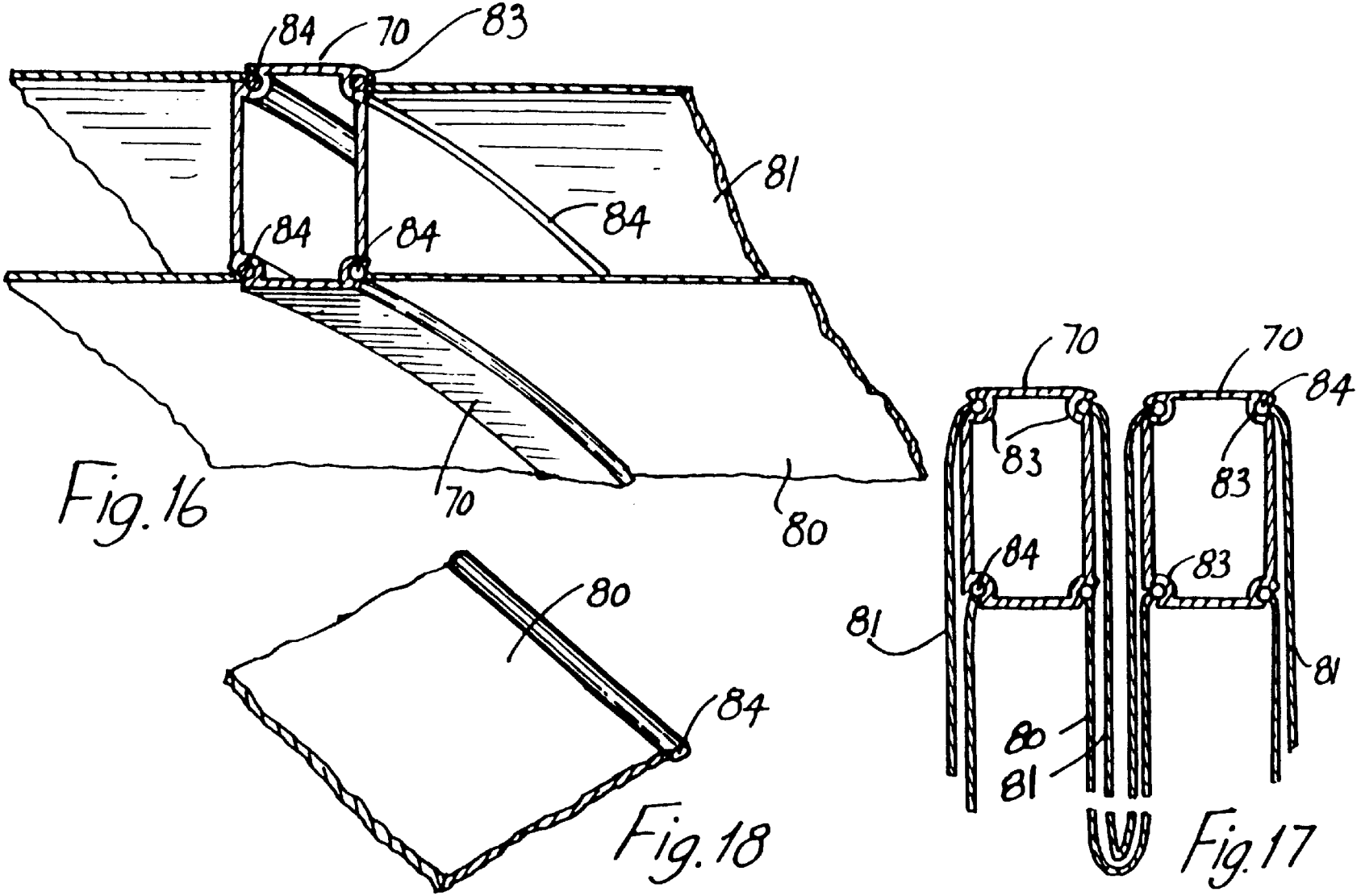
FIG. 16 is a detail, partially sectioned, perspective view of portion of the roof assembly.
FIG. 17 is a detail, partially sectioned, end elevational view of portion of the roof assembly shown in a collapsed position.
FIG. 18 is a detail, perspective view of portion of the roof assembly.

Referring in particular to FIGS. 13 to 18, the roof assembly 17 will be described in more detail. The roof assembly 17 comprises a number of arcuate rafters 70 having a carrier bracket 71 at each end with rollers 72 which are engagable with rails 73 formed by an I-beam mounted along an inner edge of the top beam 20 of the sidewalls 5. It will be noted that each bracket 71 straddles the rail 73 to securely retain the rafters 70 in engagement with the sidewalls. When in a collapsed rested position as shown in FIG. 13, the rafters 70 can be raised on the chassis by means of carriages 75 which are vertically movable by a jack on the frames 6 of the chassis 2 and then manually pulled out along each cop beam 20. Purlins 76 with a hinge joint 77 intermediate their ends extend between adjacent rafters 70. Advantageously, the purlins 76 prevent crabbing of the rafters 70 during extension and folding of the roof. The hinge joints 77 releasably lock when the purlins 76 are in the extended positions.

Roof cladding is of double-skinned construction of flexible plastics material comprising an inner ceiling sheets 80 and outer roof sheets 81. The sheets 80, 81 are mounted between each adjacent pair of rafters 70. It will be noted from FIG. 16 that each rafter 70 is of box section material having a socket 83 at each corner for reception of a bead 84 extending along an edge of each sheet 80, 81 to mount the sheets 80, 81 between adjacent rafters 70.

Figure 5:
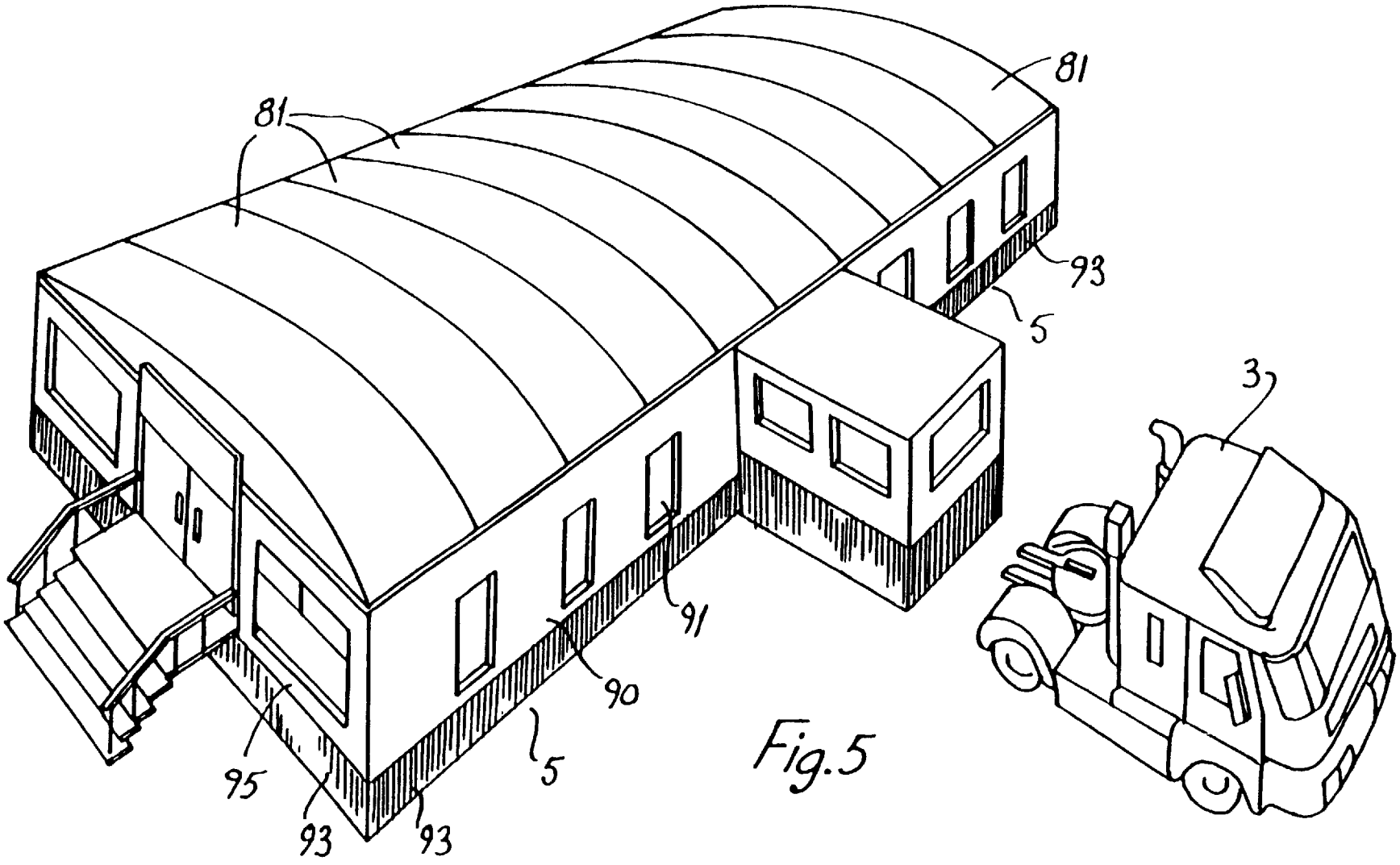

Referring to FIG. 5, cladding for the sidewalls 5 comprises wooden panels 90 with windows 91 mounted on the sidewall frames. Skirting panels 93 are mounted between a lower end of each sidewall frame and the ground. It will be appreciated that the cladding panels may be permanently fixed on the sidewall frame or they may be detachably mounted on the sidewall frame. Further, in some cases the sidewall panels may comprise a number of louvred panels which can be kept open during erection of the frame for minimising wind resistance and then closed to seal the sidewalls. In an alternative arrangement, the sidewall cladding may comprise plastics or canvas sheeting.

An end wall 95 is also provided. This is preferably mounted at a free end of the floor assembly 15. It may be pivotally mounted at the free end and folded up into the vertical position when the floor assembly 15 is extended. Alternatively, it may be vertically supported at the free end of the floor assembly 15, being moved along the sidewalls in a vertical position with the floor 15.

It will be appreciated that the invention provides a temporary building that can be conveniently transported between sites, and on site can be readily easily and quickly erected or collapsed. The relatively large folding structural elements can be readily easily handled in a controlled and secure manner.

The invention is not limited to the embodiments hereinbefore described which may be varied in both construction and detail.

I claim:

1. A transportable and collapsible temporary building, comprising a wheeled chassis, at least two building sidewalls mounted on the chassis for movement between a collapsed stored position on the chassis and an outwardly extended in-use position, one or more ground engaging supports engagable between each sidewall and the ground to support each sidewall in the extended position, a collapsible roof extendable between the sidewalls and a collapsible floor extendable between the sidewalls, the floor including a number of foldable panels interconnected by hinge joints with rollers being provided adjacent outer ends of some of the hinge joints slidably engaging complementary tracks on the sidewalls, and bias means being provided to urge the panels towards a folded position.

2. A collapsible building as claimed in claim 1 wherein the floor is engagable with the sidewalls for movement of the floor on the sidewalls between a collapsed stored position on the chassis through an intermediate partially extended position supported between the sidewalls and a fully extended position supported between the sidewalls.

3. A collapsible building as claimed in claim 1 wherein the sidewalls and floor are interengagable to retain the sidewalls in a floor supporting position.

4. A collapsible building as claimed in claim 1 wherein the bias means comprises a number of springs mounted between adjacent floor panels, the springs being extendable from a neutral position when the panels are in a folded position to an expanded tensioned position when the panels are in an open floor-forming position.

5. A collapsible building as claimed in claim 1 wherein drive means is provided for movement of the floor between a collapsed stored position and an extended position.

6. A collapsible building as claimed in claim 5 wherein the drive means is a rack mounted along each sidewall with associated pinions mounted on a drive shaft on the floor, the drive shaft connected to a drive motor for rotation of the pinions.

7. A collapsible building as claimed in claim 3 wherein the floor and sidewalls are interengagable by means of pairs of spaced-apart rollers mounted at each side of the floor and engagable with each side of the rack which passes between the rollers.

8. A collapsible building as claimed in claim 1 wherein an end wall is mounted at a free end of the floor, and wherein the end wall is pivotally mounted on the floor for movement between a folded position against a floor panel and an upright in-use position extending between the sidewalls.

9. A collapsible building as claimed in claim 8, wherein the end wall is supported vertically at a free end of the floor and is movable in an upright position with the floor along the sidewalls.

10. A collapsible building as claimed in claim 1 wherein the sidewalls are hingedly attached to the chassis.

11. A collapsible building as claimed in claim 10 wherein the sidewalls are attached to the chassis by slotted hinges.

12. A transportable and collapsible temporary building, comprising a wheeled chassis, at least two building sidewalls mounted on the chassis for movement between a collapsed stored position on the chassis and an outwardly extended in-use position, one or more ground engaging supports engagable between each sidewall and the ground to support each sidewall in the extended position, a collapsible roof extendable between the sidewalls and a collapsible floor extendable between the sidewalls, the floor including a number of foldable panels interconnected by hinge joints with rollers being provided adjacent outer ends of some of the hinge joints slidably engaging complementary tracks on the sidewalls, and ram means being provided at one or more hinge joints connected between adjacent panels, the ram means being operable to initiate folding of the panels from the open floor-forming position.

13. A transportable and collapsible temporary building, comprising a wheeled chassis, at least two building sidewalls mounted on the chassis for movement between a collapsed stored position on the chassis and an outwardly extended in-use position, one or more ground engaging supports engagable between each sidewall and the ground to support each sidewall in the extended position, a collapsible roof extendable between the sidewalls and a collapsible floor extendable between the sidewalls, the roof being movable between a nested folded position on the chassis between the sidewalls through a raised folded position on the chassis adjacent an upper end of each sidewall and a raised extended position between the sidewalls, the roof being formed by a number of rafters having rollers at each end engagable with complementary tracks at a top of each sidewall and roof cladding for mounting between the rafters in the extended position, the roof cladding being attached to the rafters, the roof cladding including flexible sheets of material mounted between adjacent rafters, and each roof cladding sheet having a bead along each side edge of the sheet located in a complementary socket extending along a side edge of each rafter.

14. A collapsible building as claimed in claim 13, wherein the roof is supported on a carriage which is vertically movable on the chassis for raising and lowering the folded roof on the chassis.

15. A collapsible building as claimed in claim 13 wherein a double-skinned roof is provided having outer roof sheets between outer ends of the rafters and inner ceiling sheets mounted between inner ends of the rafters.

* * * * *